US005895008A

United States Patent [19]

Sanders

[11] Patent Number: 5,895,008

[45] Date of Patent: Apr. 20, 1999

[54] ROLL-UP DEVICE

[75] Inventor: Robbie M. L. Sanders, Swalmen, Netherlands

[73] Assignee: Oce-Technologies, B.V., Venlo, Netherlands

[21] Appl. No.: 09/019,810

[22] Filed: Feb. 6, 1998

[30] Foreign Application Priority Data

Feb. 6, 1997 [NL] Netherlands ..... 1005209

[51] Int. Cl.[6] ..... B65H 18/20; B65H 19/26

[52] U.S. Cl. ..... 242/541.2; 242/DIG. 3

[58] Field of Search ..... 242/541.2, DIG. 3

[56] References Cited

U.S. PATENT DOCUMENTS

| | | | |
|---|---|---|---|
| 3,052,073 | 9/1962 | Johansen et al. | 242/DIG. 3 |
| 3,250,484 | 5/1966 | Fair | 242/541.2 |
| 4,542,859 | 9/1985 | Gerstenberger | 242/541.2 |
| 4,784,345 | 11/1988 | Romanowski et al. | 242/541.2 |
| 5,011,093 | 4/1991 | Mayer et al. . | |
| 5,016,833 | 5/1991 | Hamlin . | |
| 5,037,037 | 8/1991 | Mayer et al. | 242/DIG. 3 |
| 5,064,132 | 11/1991 | Merz | 242/DIG. 3 |
| 5,344,091 | 9/1994 | Molison | 242/DIG. 3 |
| 5,466,328 | 11/1995 | Nagashima . | |
| 5,538,199 | 7/1996 | Biagiotti | 242/541.2 |
| 5,639,046 | 6/1997 | Biagiotti | 242/541.2 |

FOREIGN PATENT DOCUMENTS

| | | | |
|---|---|---|---|
| 4338146A1 | 6/1994 | Germany . | |
| 61-140446 | 6/1986 | Japan | 242/541.2 |
| 62-110815 | 5/1987 | Japan | 242/541.2 |

*Primary Examiner*—John P. Darling

[57] ABSTRACT

A device for rolling up a sheet of paper into a roll and then ejecting the formed roll from the device, which includes: a frame, a first sheet drive, a second sheet drive and a first guide, the first sheet drive, second sheet drive and first guide defining a roll-forming space with respective first, second and third contact points at the periphery of the roll to be formed in the space with the first sheet drive, second sheet drive and the first guide, the roll-forming space having a center with connecting lines between the contact points forming a triangle in which the center is situated, wherein the first and second contact points are fixed, relative to the frame, and the third contact point defined by the first guide is displaceable from the roll-forming space in order to follow the increase in diameter of the roll during its formation, and the first guide is further displaceable to a position which defines an opening for ejecting a roll formed in the roll-forming space.

13 Claims, 3 Drawing Sheets

ROLL-UP DEVICE

BACKGROUND OF THE INVENTION

The present invention relates to a device for rolling up a paper web and ejecting the formed roll. More particularly, the present invention relates to a device intended for rolling up image-bearing sheets which have just been produced by copying or printing, e.g. constructional or building drawings, which are of relatively considerable length, of more than about 0.5 meter. The device of the present invention is disposed on the outlet side of a suitable (re) production machine in order to receive the sheet in web form, roll it up, frequently without a core and possibly provide it with an anti-unroll means, and eject it into a receiving tray.

A roll-up device known from U.S. Pat. No. 5,466,328 comprises a sheet feed with a top guide and a bottom guide and two drive rollers which form a nip, the sheet feed emerging into a roll-forming space defined by three arcuate guides, one of which forms the continuation of the top guide. Three roller assemblies are also provided at the periphery of the roll-forming space, two at the bottom and one at the top, and they extend inwardly between the arcuate guides and are driven in order in turn to move a fed sheet around in the roll-forming space. When the sheet has been completely rolled up, the bottom two drive roller assemblies with the guide extending between them are swung away so that the roll-forming space forms an ejection opening at the bottom, from which the roll can drop down into a receiving tray. For the pivoting of the bottom drive roller assemblies, and hence also at least a part of the drive mechanism for these rollers, a relatively complex and space-occupying construction is required, which can result in malfunctioning of the roll-up device. During the forming of the roll, the diameter of the roll-forming space in the known roll-up device is determined by the gripper surfaces of the drive roller assemblies, which are disposed at fixed points during the roll-up process. This results in constraints on the dimensions of the sheet rolls which can be made with this device.

A simpler roll-up device is known from German Patent Application 43 38 146. This roll-up device comprises a roll-forming space defined by two drive roller assemblies situated diametrically above and opposite one another and two arcuate guides which are also disposed diametrically opposite one another and which extend substantially along the periphery between the drive rollers. One arcuate guide and the bottom drive roller assembly are disposed at fixed points. The other, top drive roller assembly is so mounted in the frame that it can move in a radially outward and upward direction. The other, pivotable guide can also be pivoted away for this purpose after the first coil of the roll has been completed. As a result, during formation, the roll has the opportunity of increasing in size while the sheet drive and guidance continue. After the roll is complete, an adhesive strip is fed over the fixed roller assembly in order to close the formed roll, and with the guide completely swung away an ejection opening is freed for the roll. By only driving the bottom roller assembly at the fixed point, the roll is forced out of the roll-forming space and can drop into a receiving tray. With this roll-up device as well, additional steps are required to make a drive roller assembly movable.

U.S. Pat. No. 5,011,093 discloses a roll-up device in which the roll-forming space is bounded at the top by a fixed arcuate guide provided with a number of freely rotating rollers for reducing the friction. At the bottom, the roll-forming space is defined by a comparable arcuate guide which, however, is pivotable so that it can be swung away after the rolling process in order to free an ejection opening for the roll. Also, this bottom guide is so suspended from the top guide that it can yield, to a limited degree, against the spring force to follow an increase in the size of the roll during formation. At one end the bottom guide is also provided with a drive roller driven by a freely rotating roller disposed in the sheet feed path and itself driven by a driven roller with which this roller forms a nip. One disadvantage of this roll-up device is that when the bottom guide yields during the formation of the roll, the degree of engagement between the drive roller and the freely rotating roll is changed. Steps must also be taken to enable the drive roller to be moved away from the freely rotating roll during the pivoting away of the bottom guide. As a result of the reduced degree to which the bottom guide can yield, the lengths of sheets for rolling are also limited, with lengths of 1.5 to 3 meters being referred to.

There is a need for a simple roll-up device capable of reliably rolling up a wide variety of relatively considerable lengths (e.g. from 0.5 to 10 meters) of image-bearing sheets, such as copy sheets and drawings. The sheet should be permanently driven at the roll periphery during the rolling-up process and the roll should have space to increase in size.

SUMMARY OF THE INVENTION

The object of the present invention is to provide a device for rolling up a sheet of paper and ejecting the formed roll, comprising a frame, a roll-forming space and feed means for transporting the paper web to the roll-forming space, wherein the roll-forming space is bounded, during the rolling up process, on at least three contact points disposed in a spaced-apart relationship in the peripheral direction of the roll, wherein the roll-forming space has a center and the connecting lines between the said contact points form a triangle in which the center of the roll-forming space is situated, wherein two of the said contact points are disposed at a fixed point in the frame and are each formed by driven sheet drive means, and wherein the third of said contact point is disposed to be displaceable in the frame in order to follow the increase in the diameter of the roll during its formation. The roll-forming space is also provided with first guide means which guides the paper web, at least during a first revolution, along a curved roll-up path, and wherein the first guide means and the said third contact point are displaceable between a position in which they define the roll-forming space and a position in which they are displaced, leaving an ejection opening free for a roll to be formed in the roll-forming space.

In the device according to the present invention, the two sheet drive means, which are preferably formed as drive rollers, provide an adequate permanent drive, but in the roll-forming space they are situated at fixed points such that they leave the greater part of the periphery of the roll-forming space free and thus do not extend into the path of the formed roll during its ejection. As a result they can remain in place and no steps have to be taken to move the sheet drive means. Since the sheet drive means are situated on the same side of the center of the roll-forming space, there is also a space for an increase in the size of the roll on the other side. The third contact point situated there simply has to function as such and can be made movable by suitable means in order to be able to provide the movements described.

It should be noted that U.S. Pat. No. 5,016,833 discloses a roll-up device having a roll-forming space defined by two fixed drive roller assemblies situated diametrically opposite one another in a substantially horizontal direction, and two sets of arcuate guide fingers which are pivotable away about different axes situated diametrically opposite one another. In the roll-forming space there is provided a C-shaped ring which is pressed in to some extent and in which the sheet is rolled up. After rolling up, the C-shaped ring is released so that it can expand again to some extent. According to this description, therefore, the rolled-up sheet can expand. The two guides are then pivoted away so that the rolled-up sheet with the C-shaped ring can drop by gravity from the roll-forming space. The expanded, rolled-up sheet which, before it drops, is in contact with the drive roller assemblies, however, can obstruct the falling movement.

Preferably, the two sheet drive means are disposed one above the other and the bottom sheet drive means forms a contact point which is situated in the horizontal direction between the contact point of the top sheet drive means and the center of the roll-forming space. As a result, the roll will not lie in a stable position if it is supported solely by the sheet drive means. When the third contact point is removed, therefore, the roll will drop from the roll-forming space by itself.

Preferably, the third contact point adjoins the first guide means, it being advantageous if they form a unit with one another. The first guide means, which can be formed as curved fingers, will then form the third contact point with part of said fingers, so that the arrangement is maintained extremely simple. Further simplification is obtained if the first guide means and the third contact point are pivotable about the same axis.

In an alternative embodiment, in which the first guide means are pivotable about a first axis, said axis is formed by a rod which forms the third contact point and is itself mounted to be pivotable about an axis spaced from the first axis.

In a further development of the device according to the present invention, the roll-forming space is also provided with second guide means, which guide the paper web at least during a first revolution along a curved roll-up path and which, in the roll-up direction, follow on the first guide means and are followed by one of the said sheet drive means and are displaceable between a position in which they define the roll-forming space and a position in which they leave the ejection opening free from the roll-forming space. In this case, the first guide means and the second guide means respectively, can be mounted to a pivot about a first axis and a second axis in a frame, the first and second axes being spaced apart.

Alternatively, the first guide means and the second guide means are pivotable about a common axis in the frame and are pivotable in opposite directions. The common axis can be formed by a rod which forms the third contact point and is itself pivotable in the frame about an axis spaced from the common axis.

BRIEF DESCRIPTION OF THE DRAWINGS

The invention will now be explained with reference to a number of exemplified embodiments illustrated in the accompanying drawings, wherein.

DETAILED DESCRIPTION OF THE INVENTION

Figure 1:
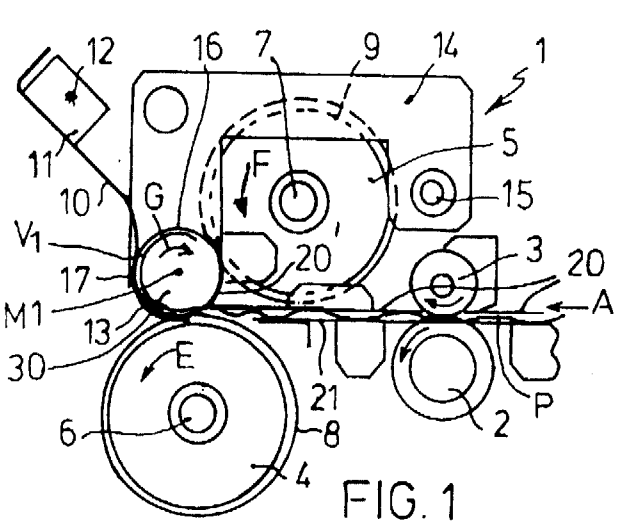
FIG. 1 is a diagrammatic front elevation of a first embodiment of the device according to the present invention, during the entry of a sheet into the roll-forming space.

The roll-up device 1 according to the present invention as shown in FIG. 1 is so disposed by means of its frame (not shown in detail) that its right-hand side, looking at the drawing, follows the outlet of a copying machine, plotter or the like. The sheet P which is to be rolled up enters the roll-up device 1 from the direction A. The sheet P, which may have a length in the range of from 0.5 to 10 meters, is driven on by the drive entry roller 2 and the pressure roller 3 disposed thereabove, with the rollers 2 and 3 forming a nip. The top entry plate 20 and the bottom entry plate 21 form a guide between which the leading edge of the sheet P enters the roll forming space 30.

The roll-forming space 30 is bounded successively by surface 8 of the stationary roller assembly 4 driven about shaft 6, and the guide surface 13 of fingers 10, which are fixed on a support block 11 pivotable about a pivot 12 by means not shown in detail. The roll-forming space 30 is then bounded by guide surface 16, which forms the hollow end edge of the left-hand limb of U-shaped plates 14 pivotable around pivot 15 by means not shown in detail, and surface 9 of the stationary roller assembly 5 driven about shaft 7 by means not shown in detail. Finally, the space 30 is bounded by a bent upright left-hand end portion 20' of the top guide 20. The surfaces 8, 9, 13 and 16 need not be in one vertical plane with respect to one another. In this case a plurality of rollers 4 and a plurality of rollers 5 are involved, which are disposed next to one another on their respective shafts 6 and 7. The fingers 10 extend by surfaces 13 and the U-shaped plates extend by surfaces 16 into the spaces between the adjacent rollers 4 and 5. The surfaces 16 and 13 can also be situated next to one another in a transverse direction to the drawing plane. Thus FIG. 1 clearly shows that the bottom left-hand end 17 of the hollow surface 16 is situated in a direction perpendicular to the drawing plane next to the fingers 10. The important feature here is that at least during the first circuit of the leading edge of the sheet P a continuous peripheral guide is created in the roll-forming space 30.

During the further advance of the sheet P in the direction A and on continued rotation of the rollers 4 and 5 respectively in the directions E and F, the roll V1 present in the roll-forming space 30 will be compelled to turn round in the direction G, this taking place at a speed adapted to the effective speed of the input rollers 2.

Figure 2:
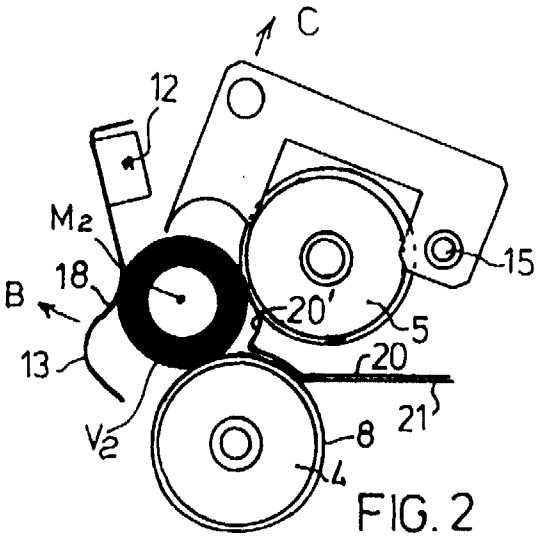
FIG. 2 is a similar elevation to FIG. 1 at the end phase of the rolling operation.
Figure 3:
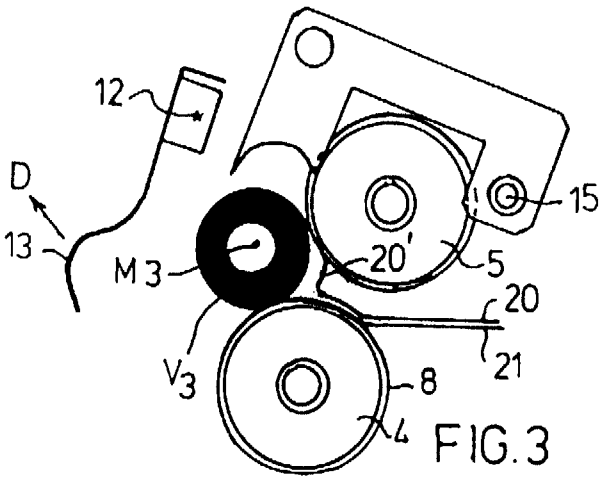
FIG. 3 is a similar elevation to FIG. 1 at the start of the removal of the formed roll.

After at least one revolution has been formed for the roll V1, the further roll-up process in principle only requires three contact points so positioned that they retain in position the roll V1 placed between them. The guide surfaces 13 and 16 are then no longer absolutely essential. Thus as seen in FIG. 2, in order to reduce the friction on the roll during the forming process, the U-shaped plates 14 are swung up about the pivot 15 in the direction C. The rollers 4 and 5 have remained in position during this operation. However, the fingers 10 are pivoted to some extent about the axis 12 in the direction B, in the clockwise direction when looking at the drawing. A spring means (not shown) forces the fingers 10 back in a somewhat opposite direction. This force is such that the roll (V2: see FIG. 2) can press the fingers 10 away during the forming process as a result of the increase in the periphery of the roll, but the force is also such that the fingers 10, and particularly their contact surface 18 with the periphery of the roll V2, prevent the latter from dropping down to the bottom left, looking at the drawing. The fingers 10 can also be spring biased toward the surface of the roll V2. It will be apparent that the contact surface 18 of the roll V2 moves upwards with the fingers 10 during the progression of the roll-up process. In order to reduce friction between the contact surface 18 and the roll during rolling up, freely rotatable rollers can be mounted between the fingers 10 at the location of the contact surface 18.

Figure 4:
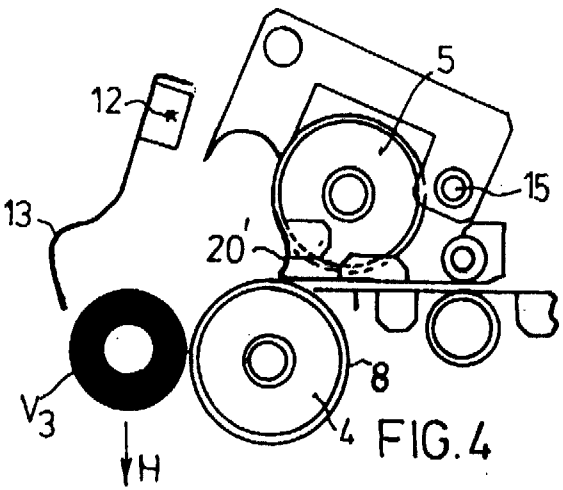
FIG. 4 is a similar elevation to FIG. 1 showing the removal of the formed roll.

Finally, the entire sheet P is rolled up, without a core, to form the roll V3. This roll has a center point M3 which, looking at the drawing, is somewhat to the left of the center point M2 of the roll V2, which center point also is already to the left with respect to the center point M1 of the initial roll-forming space 30. The arrangement selected for the rollers 4 and 5 and the distance between them has the effect that the center point M1–M3, as considered in the drawing, lies to the left of the center point of the shaft 6. By removing the contact surface 18 from the roll V3, which in this case is effected by pivoting the fingers 10 further away in the direction D, the roll V3 will of itself drop down to the left, as shown in the drawing, over the surface of the rollers 4 in the direction H (see FIG. 4) on its way to a receiving tray. This process can be assisted by continuing to drive the rollers 4 and/or the rollers 5.

Thus a simple mechanism enables the sheet P, which can, for example, be 8 meters long, to be rolled up.

Figure 5:
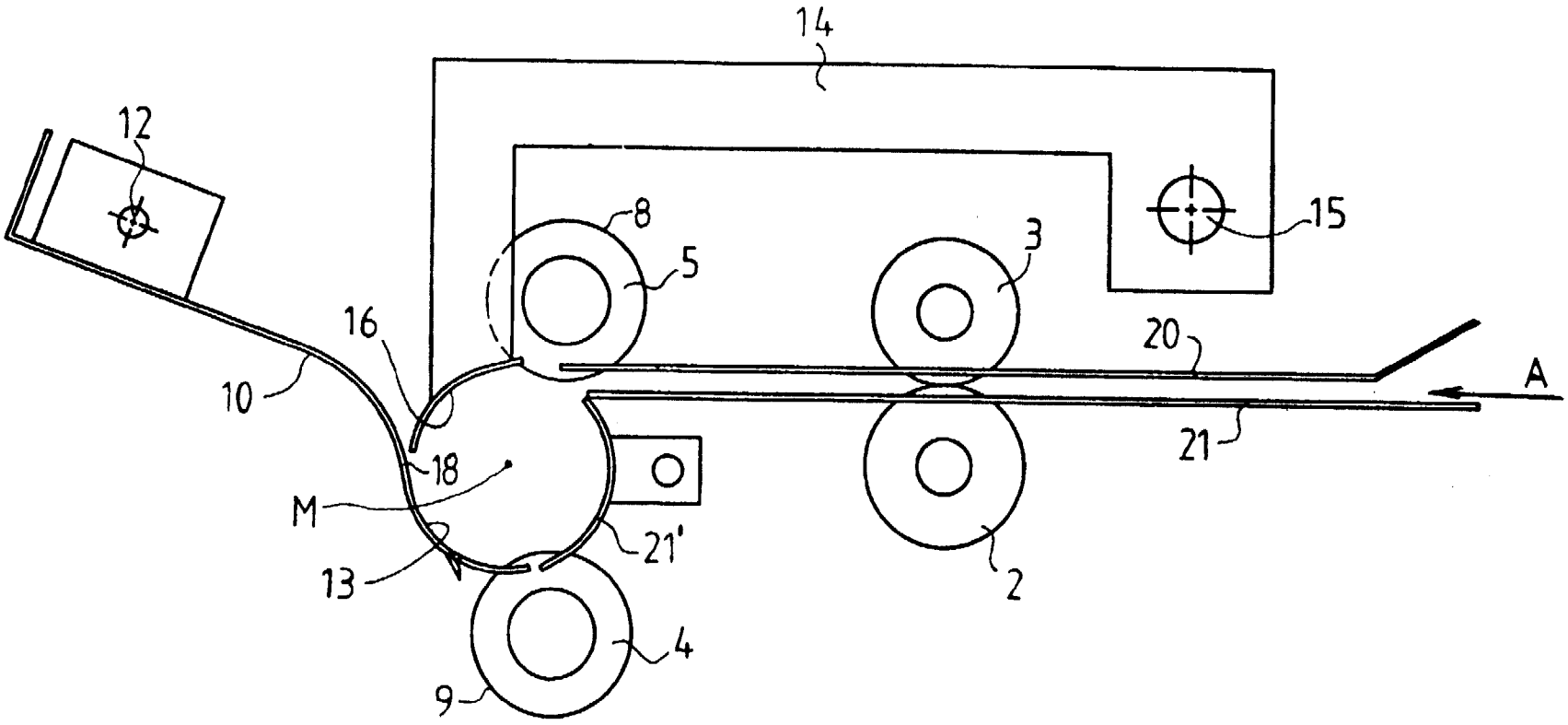
FIG. 5 is a diagrammatic front elevation of a second embodiment of the device according to the present invention.

FIG. 5 shows one embodiment of a roll-up device which rolls a sheet up in a downward direction. This is in contrast to the roll-up device shown in FIGS. 1 to 4, which rolls a sheet up in an upward direction.

A sheet printed on one side can thus be rolled up either with the image side facing outward, for example so that the indicia on a rolled-up drawing can be kept directly visible, or with the image side facing inward, for example to protect the image of a rolled-up poster. As will be apparent from FIG. 5, the roll-up device shown there comprises the same components as the roll-up device shown in FIGS. 1 to 4. The same reference numbers are therefore used in FIGS. 1 to 5.

Since the entry path in the case of a downwardly extending roll-up method must follow the top of the roll-forming space 30, roller 5 is disposed at said top side and the bottom guide 21 is extended downwardly to form end portion 21' (instead of providing an extension of the top guide 20 to form end portion 20' as in the case of the upward roll-up method). The position of the movable guides 13 and 16 is adapted to the changed position of roller 5, the action otherwise being unchanged.

Figure 6:
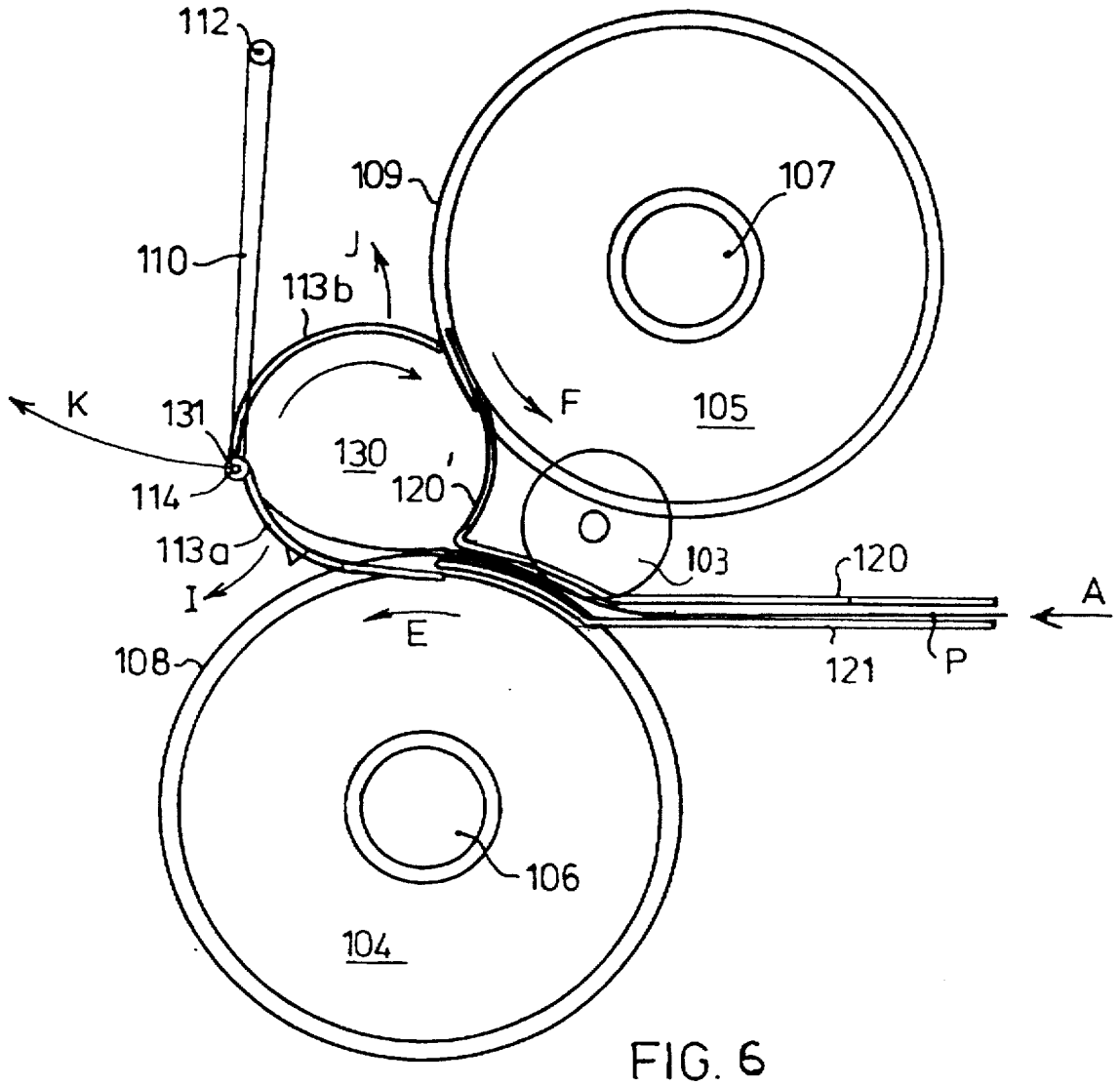
FIG. 6 is a detail of a third embodiment of the device according to the present invention.

FIG. 6 shows only a part of the roll-up device in an alternative embodiment. Here the sheet P again enters between the entry plates 120 and 121, in the direction A, and is pushed towards the roll-forming space 130 by means of entry roller 103 which co-operates with a roller 104. This entry position does away with roller 2 shown in FIG. 1, because roller 104 also performs the function of roller 2. This double function can also be performed by roller 4 in the roll-up device shown in FIGS. 1 to 4, by placing roller 3 at roller 4 in the same manner as in FIG. 5. Like the roll-forming space 30 of FIGS. 1 to 4, the roll-forming space 130 is also defined by surfaces 108 and 109 of respective rollers 104 and 105 driven in the directions E and F. However, the roll-forming space 130 is further defined by guide fingers **113*a* and 113*b*, both of which having a hollow configuration and are pivotally secured at 114 on a bar 131 extending perpendicularly to the drawing plane. Bar 131 is suspended from rods 110, which are pivotable about an axis 112 of the frame extending perpendicularly to the drawing plane. Drive means (not shown) can pivot the rods 110 in the direction K when necessary. Guide fingers 113*a* and 113*b* can be swung away by means not shown in the directions I and J respectively about the pivot 114, after at least the first revolution of the roll. The bar 131 suspended from the pivot 112 will then press lightly against the roll surface under the influence of gravity, and possibly also a spring bias or a spring force, in order to form a third contact point. As the periphery of the formed roll increases in the roll-forming space 130, the roll can push the bar 131 away to the left in the drawing, but the weight of the bar ensures that the third contact point is retained. Once the roll is completed, the above-mentioned means not shown can actively pivot the bar 131 away to the left in the drawing in order that the roll can drop from the roll-forming space 130** into the receiving tray.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for rolling up a sheet of paper into a roll and then ejecting the formed roll from the device, which comprises:

a frame, first sheet drive means, a second sheet drive means, and a firsts guide means, said first sheet drive means, second sheet drive means and first guide means defining a roll-forming space with respective first, second and third contact points at the periphery of the roll to be formed in said space with said first and second sheet drive means and said first guide means, said roll-forming space having a center with connecting lines between the contact points forming a triangle in which the center is situated, wherein said first and second contact points are fixed, relative to said frame, and said third contact point defined by said first guide means is displaceable from said roll-forming space in order to follow the increase in diameter of the roll during its formation, said first guide means being further displaceable to a position which defines an opening for ejecting a roll formed in the roll-forming space, wherein said first and second sheet drive means are disposed one above the other and wherein the second or bottom sheet drive means forms its contact point which, in the horizontal direction, is disposed between the contact point of the first or top sheet drive means and the center of the roll-forming space.

2. The device of claim 1, wherein feed means are provided for transporting a paper web to the roll-forming space.

3. The device of claim 1, wherein the first guide means is biased in a direction toward the roll-forming space.

4. The device of claim 1, wherein the third-contact point is adjacent to the first guide means.

5. The device of claim 4, wherein the third contact point and the first guide means are integral with each other.

6. The device of claim 5, wherein the third contact point and the first guide means are integral with and extend from finger means.

7. The device of claim 5, wherein the third contact point, the first guide means, and a finger means are pivoted about a common axis.

8. The device of claim 5, wherein the first guide means and the third contact point are pivotable about the same first axis, said first axis being formed by a bar which forms the third contact point and is itself pivotable about a second axis situated at a distance from said first axis.

9. The device of claim 1, wherein the roll-forming space is provided with a separate second guide means which guides the paper web at least during the first revolution along a curved, roll-up path and which, in the roll-up direction, follows the first guide means and is followed by one of the said sheet drive means and is displaceable between a position in which it defines the roll-forming space to a position which defines an opening for ejecting a roll formed in the roll-forming space.

10. The device of claim 9, wherein the first guide means and the second guide means are pivotable about a third axis and a fourth axis in the frame, respectively, the third axis and the fourth axis being spaced apart.

11. The device of claim 9, wherein the first guide means and the second guide means are pivotable about a common axis in the frame and are pivotable in opposite directions.

12. The device of claim 11, wherein the common axis is formed by a bar which forms the third contact point and is itself pivotable in the frame about an axis spaced apart from the common axis.

13. The device of claim 1, wherein a feed means for transporting the paper web to the roll-forming space is formed by one of the driven sheet drive means and a pressure roller which forms a feed nip therewith.

* * * * *